United States Patent [19]

Dunlay et al.

[11] 3,932,776

[45] Jan. 13, 1976

[54] COLD FUEL THERMIONIC CONVERTER

[75] Inventors: John B. Dunlay; Robert C. Howard, both of Wayland, Mass.

[73] Assignee: Thermo Electron Corporation, Waltham, Mass.

[22] Filed: Dec. 9, 1966

[21] Appl. No.: 600,488

[52] U.S. Cl. ..... 310/4

[51] Int. Cl. ..... H01j 45/00

[58] Field of Search ..... 310/3, 4; 176/39

[56] References Cited

UNITED STATES PATENTS

| | | | |
|---|---|---|---|
| 3,079,515 | 2/1963 | Saldi | 310/4 |
| 3,093,567 | 6/1963 | Jablonski et al. | 310/4 X |
| 3,129,345 | 4/1964 | Hatsopoulos et al. | 310/4 |
| 3,227,900 | 1/1966 | Sidoti | 310/4 |
| 3,274,404 | 9/1966 | Eichenbaum | 310/4 |
| 3,275,923 | 9/1966 | Laing et al. | 310/4 X |
| 3,300,661 | 1/1967 | Talaat | 310/4 |

*Primary Examiner*—Donovan F. Duggan
*Attorney, Agent, or Firm*—Kenway & Jenney

[57] ABSTRACT

An energy source for a heat-utilizing device which includes a source of gamma radiation, an absorber of such radiation and a heat-utilization device in heat-transfer relationship with the absorber of gamma radiation. The enclosure of the energy source is so constructed that additional heat-utilizing device may also be energized from the same source of gamma radiation.

2 Claims, 1 Drawing Figure

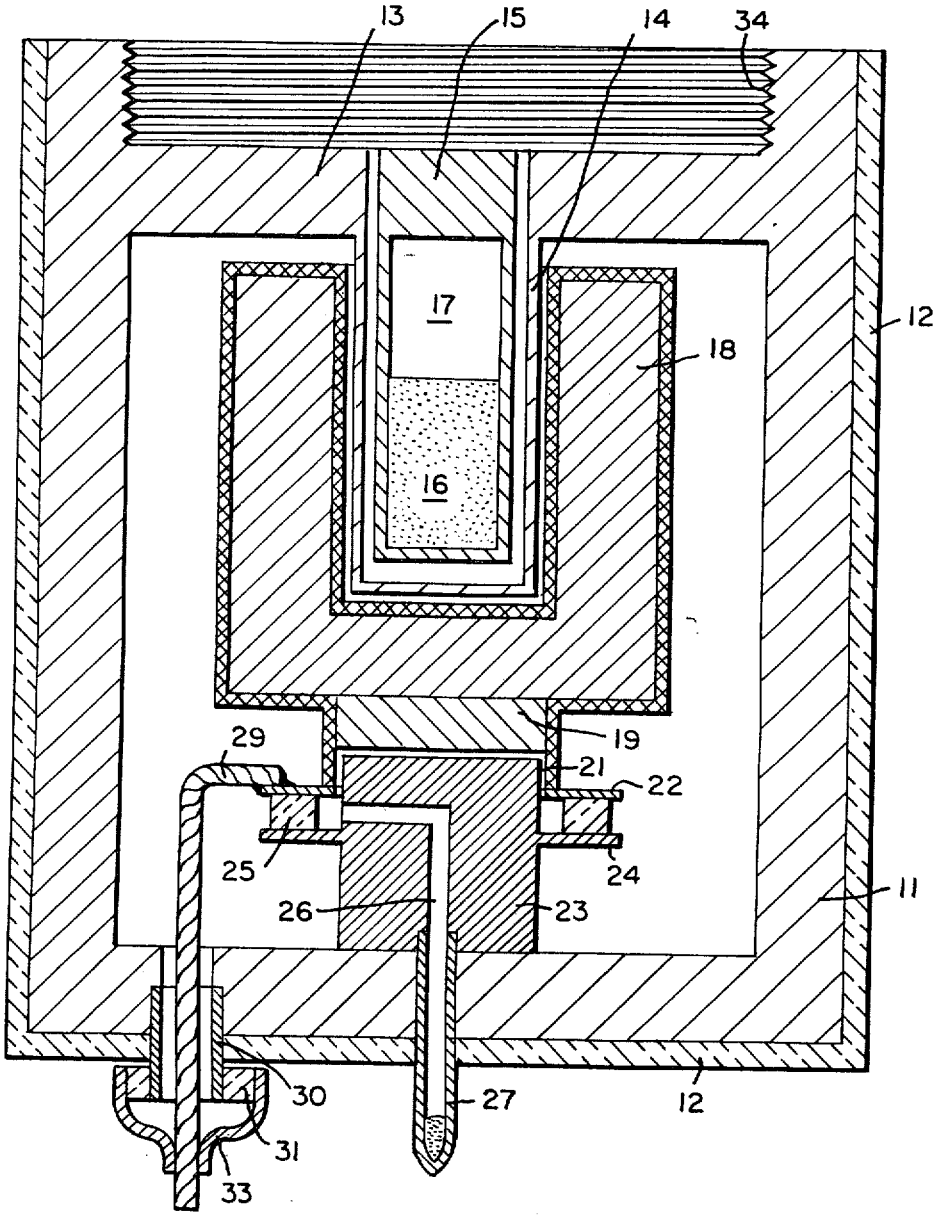
INVENTORS
JOHN B. DUNLAY
ROBERT C. HOWARD
BY,
Kenway, Jenney + Hildreth
ATTORNEYS

COLD FUEL THERMIONIC CONVERTER

This invention relates in general to energy conversion systems using isotope fuels and in particular to "cold" isotope fuel converters.

The feasibility of utilizing radiation from isotopes to generate heat has been proven in several environments. For example, systems have been designed in which the alpha radiation of the isotope is used to provide bursts of energy which are converted to heat. There has also been some experimentation with the conversion of gamma radiation to heat, heat from such systems being developed on a more sustained basis.

However, the fact that the isotope fuel itself reaches temperatures anywhere from 500°C. to 2000°C. as the gamma radiation is absorbed in the fuel has seriously limited the possible applications to which this type of fuel may be put. In such areas as thermionics where it is desired to convert the heat to electricity, the high temperatures are desirable to operate the emitter, but they cause extreme difficulty in the isotope fuel itself.

Obviously, the fuel must be kept in a container and as the fuel reaches high temperatures, chemical and metallurgical incompatibilities between fuel and container arise or are aggravated. The expansion of the fuel, the container and the device to which the heat is being supplied cause dimensional instabilities.

The problems outlined are common to practically all converters, but they are magnified and increased in number in connection with thermionic converters. Examples of some of these other problems are the complexities and difficulties of joining the fuel with the emitter of the thermionic converter and the difficulty of controlling the temperature of the emitter with decreasing emission from the isotope as it decays. Control of emitter temperature has also been found to be troublesome when changes are made in the load placed upon the output of the thermionic converter.

It is, therefore, the broad general object of the present invention to make efficient and practical the use of isotope fuel in a broad range of converter applications.

It is another object of the present invention to simplify and reduce costs in the use of isotope fuels.

Still another object of the present invention is the improvement of thermionic converters by the provision of a practical isotope fuel heat source.

A further object of the present invention is the operation of energy converters including thermionic converters with a relatively cold heat source.

Generally, the present invention consists in a system the heart of which is a capsule of isotope fuel emitting primarily gamma radiation. A sink is provided to absorb the major portion of the gamma radiation emitted by the fuel. This sink is disposed in proximity to, or in contact with, the basic heat utilization device of the converter system. In the case of a thermionic converter, the basic element is, of course, the emitter. By proper design and selection of materials, approximately 70% of the total gamma radiation from the fuel can be converted to useful thermal energy. Moreover, the design of the system is such that it is possible to provide semi-cascaded power conversion or generation.

For a better understanding of the present invention, together with other and further objects, features and advantages, reference should be made to the following specification which should be read in conjunction with the appended drawing, the single FIGURE of which is a sectional view in elevation of a thermionic conversion system embodying the present invention.

In the drawing there may be seen a generally cylindrical housing 11 made preferably of a material having both structural strength and relatively high thermal conductivity. A sandwich-type of arrangement of copper and stainless steel or a cobalt alloy such as Haynes-25, made by Union Carbide Company has proven suitable. Surrounding the circumferential surface of the housing and enclosing its lower end is a layer of thermal insulating material 12. Any one of several materials such as MIN-K, made by Johns Manville Corporation, is suitable for the layer 12, the only requirement being that the loss of heat from the generator housing 11 be minimized. The top of the housing 11 is recessed from the circumferential walls and it consists of an integral or welded disc-shaped plug 13 having an axial opening from which there depends a relatively thin-walled capsule sleeve 14 having a closed lower end. Parenthetically, it should be noted that the cylindrical configuration of the housing and its overlying thermal insulating layer 12 is not essential to the practice of the invention. Any one of numerous configurations might equally well be used.

Centrally disposed in the shell 14 adjacent the top of the housing, is a capsule 15. The capsule 15 contains a quantity of isotope fuel 16 and a coolant 17. The material of which the capsule is made may also be similar to that of the housing but it should be non-reactive with the isotope fuel. The type of isotope fuel used has as its essential characteristic the capacity for emitting gamma radiation. Such typical gamma radiators as $Co^{60}$ or $Sr^{90}$ are suitable. Insofar as the coolant 17 is concerned, it may be a simple liquid, gas, or solid or a combination of the three. As obvious examples, either water or liquid metal might be used and natural circulation within the coolant would serve to transfer heat generated by gamma absorption in the fuel to the upper end of the capsule. Alternatively, a "heat pipe" might be utilized as the convective mechanism. Actually, only a relatively small fraction of the gamma radiation emitted by the isotope fuel is absorbed by the fuel and the capsule wall.

Quite important to the operation of the invention is the handling of the larger fraction of the gamma radiation emitted by the fuel and primarily absorbed by a heat sink 18 which substantially surrounds the capsule. The heat sink 18 is preferably composed of a metal such as tungsten and may have the configuration of an open-ended heavy-walled cylinder. The heat sink 18 is totally enclosed in a multi-foil thermal insulating layer 20 except for a central lower portion to which the upper surface of an emitter 19 is bonded in intimate contact and good heat-transfer relationship.

Because of the arrangement of the heat sink 18 which serves as a receptacle for and substantially surrounds the capsule 15 but which does not interfere with the conduction of heat from the fuel 16 and the capsule 15 upwardly, the isotope fuel temperature remains essentially independent of the emitter temperature and may be as low as 100°C. while heating the emitter to a temperature of more than 2000°C.

The emitter 19 has the general shape of a disc from the circumferential walls of which there extends downwardly a shell 21 which terminates in an outwardly flaring collar 22. Cooperating with the emitter 19 to form the other basic component of a thermionic converter is a collector 23 which projects upwardly within the shell 21 to terminate in a flat surface closely spaced from the active lower surface of the emitter 19. The collector 23 includes a flared collar 24 corresponding generally to the flared collar 22 on the shell of the emitter. The two collars are sealed together by means of a ceramic-to-metal seal indicated by the ceramic member 25. A passage 26 is formed through the collector 23 and it may be formed by radial and axial bores intersecting roughly centrally of the collector 23. A tubular reservoir 27 of liquid cesium is sealed through the housing 11 and the insulating layer 12 to place the enclosed cesium in communication with the passage 26, whereby cesium vapor is made available in the emitter-collector space.

Necessary electrical connections may be made in the one case directly to any convenient point on the housing 11 and, in the other case, to the emitter 19 by means of a lead 29 welded to the collar 22. The lead 29 is bent at a right angle to extend through an opening formed in the generator housing 11 and the insulating layer 12. The lead 29 is physically and electrically isolated from the housing 11 as by means of a ceramic-to-metal feed-through. This latter device may include a metallic sleeve 30 welded into the opening in the generator housing and sealed to a ceramic member 31 which, in turn, is sealed to a tapered closure 33 having its narrow end welded back upon the lead 29.

In order not to waste the heat which does not find utilization at the emitter 19, there is provided a threaded connection 34 on the inner surface of the circumferential wall at the top of the generator housing. This connection may serve as the input to another power conversion device such as a steam engine, a thermoelectric generator, a Brayton cycle engine system or the like for semi-cascaded operation.

As was noted previously, the largest fraction of the gamma radiation emitted by the fuel is absorbed by the emitter sink 18. Most of this heat generated by the absorption is conducted down the sink to the emitter 19. Some of the heat is lost by thermal radiation and conduction through the insulating layer 20 and another small fraction of the gamma radiation is absorbed by the portion of the thermally insulating layer 20 adjacent the capsule. Also, of course, a small portion of the gamma radiation is absorbed by the capsule sleeve 14. Most of the heat lost in this fashion is transferred ultimately to the upper end of the generator housing 11 or to the upper end of the capsule 15. Finally, a small fraction of the gamma radiation emitted by the fuel is absorbed by the upper end of the fuel capsule and the generator housing. However, by proper design and selection of suitable materials, approximately 70% of the total gamma radiation emitted by the fuel can be transmitted to the emitter 19 as thermal energy. In practice, then, the 30% of the gamma radiation which does not reach the emitter may be withdrawn as useful power for a secondary device at the top of the generator housing.

Assuming that two-thirds of the gamma radiation reaches the emitter as thermal energy, if both the thermionic converter and the secondary device have efficiencies of 15%, and if the outer insulating layer 12 has a negligible heat loss, the overall efficiency of the generator may be expressed as follows:

$$n = 0.15\ (\tfrac{2}{3}) + 0.15\ [1 - 0.15\ (\tfrac{2}{3})]$$
$$= 0.10 + 0.15\ (0.9)$$
$$= 0.235$$
$$n = 23.5\%$$

Although what has been disclosed constitutes a preferred embodiment of the invention, numerous modifications and alternatives will suggest themselves to those skilled in the art upon a reading of the foregoing specification. By way of example, although not in a limiting sense, one might remove heat directly from the circumferential surface of the housing 11. Alternatively, coolant tubes might be distributed throughout the device to remove heat, or multiple thermionic converters of the same or different configurations might be operated from a single fuel capsule and connected in series-parallel combinations. Still other arrangements are possible such as the use of multiple fuel capsules and thermionic converters operated with the emitter heat sinks close together but electrically insulated one from another to reduce thermal losses from the heat sinks. Generally, the utilization of gamma radiation for heating the conversion device and the thermal insulation of the fuel capsule from the object to be heated are at the heart of the invention which should be limited only by the spirit and scope of the appended claims.

What is claimed is:

1. An energy conversion system comprising an externally insulated housing, a heat sink in the shape of an open-ended receptacle, a capsule of isotope fuel disposed in said heat sink and having a portion thereof extending beyond said, said heat sink being thermally insulated from said capsule and disposed in said housing to receive gamma radiation from said capsule, and a heat utilization device disposed in heat-transfer relationship to said heat sink for deriving heat therefrom, said housing including a portion thereof in heat-transfer relationship with said portion of said capsule extending beyond said heat sink.

2. An energy conversion system comprising an externally insulated housing, a capsule containing a quantity of isotope fuel and a coolant disposed in said housing said isotope fuel emitting gamma radiation, a heat sink substantially surrounding and thermally insulated from said capsule also disposed in said housing for absorbing gamma radiation and a heat utilization device disposed in heat-transfer relationship to said heat sink for deriving heat therefrom.

* * * * *